United States Patent [19]

Horner

[11] Patent Number: 4,767,019

[45] Date of Patent: Aug. 30, 1988

[54] SPLASH RESISTANT CUP LID

[76] Inventor: Tommy D. Horner, 3440 N. Beltline Rd., No. 1066, Irving, Tex. 75062

[21] Appl. No.: 101,353

[22] Filed: Sep. 25, 1987

[51] Int. Cl.[4] ..... A47G 19/22

[52] U.S. Cl. ..... 220/90.4; 264/553

[58] Field of Search ..... 220/90.2, 90.4, 90.6; 229/7 R; 264/553

[56] References Cited

U.S. PATENT DOCUMENTS

| | | | |
|---|---|---|---|
| 2,456,989 | 12/1948 | Polcyn | 65/13 |
| 2,601,767 | 7/1952 | Wall | 65/13 |
| 3,152,735 | 10/1964 | Caldwell | 222/455 |
| 3,727,808 | 4/1973 | Fitzgerald | 222/482 |
| 3,797,696 | 3/1974 | Dibrell | 220/90.4 |
| 3,806,023 | 4/1974 | Barnett | 229/43 |
| 3,895,743 | 7/1975 | Christian | 222/143 |
| 3,915,331 | 10/1975 | Chenault | 220/90.4 |
| 3,915,355 | 10/1975 | Young | 222/478 |
| 3,938,695 | 2/1976 | Ruff | 220/90.4 |
| 3,994,411 | 11/1976 | Elfelt | 220/90.4 |
| 4,085,861 | 4/1978 | Ruff | 220/90.4 |
| 4,130,215 | 12/1978 | Corey et al. | 220/90.4 |
| 4,136,799 | 1/1979 | Albert | 220/415 |
| 4,187,954 | 2/1980 | Striggow | 220/90 |
| 4,245,752 | 1/1981 | Prueher | 220/90.4 |
| 4,394,928 | 7/1983 | Philip | 220/366 |
| 4,412,629 | 11/1983 | Dart et al. | 220/90.4 |
| 4,489,848 | 12/1984 | Braude | 220/90.4 |
| 4,503,992 | 3/1985 | Sitko et al. | 220/90.4 |
| 4,566,605 | 1/1986 | Rogers | 220/90.2 |
| 4,574,970 | 3/1986 | Schwarz | 220/90.4 |
| 4,582,214 | 4/1986 | Dart et al. | 220/90.4 |
| 4,589,569 | 5/1986 | Clements | 220/380 |
| 4,619,372 | 10/1986 | McFarland | 220/90.4 |

*Primary Examiner*—G. T. Hall

*Attorney, Agent, or Firm*—Sigalos & Levine

[57] ABSTRACT

A spill resistant lid having a rim structure adapted to engage a lip around the mouth of a drinking container in a substantially leak proof manner comprising a canopy suspended from the rim structure forming a shallow reservoir sized to fit into the mouth of the container and a vertical opening in the canopy which deflects fluid from splashing but which permits metered flow of beverage for convenient consumption.

11 Claims, 2 Drawing Sheets

SPLASH RESISTANT CUP LID

BACKGROUND OF THE INVENTION

The invention relates to a splash resistant cup lid and a method of making same and in particular to a lid of the type for use on disposable hot beverage cups or containers and a method for making a disposable cup lid which is suitable for vacuum forming.

Along with the proliferation of fast food restaurants and extensive public and private transportation such as air plane and automotive travel, has come the need for transporting potable beverages in single serving size containers which are portable, disposable, and spill resistant. Particularly annoying are spills and splashes caused by beverage sloshing resulting from the normal jostling associated with drinking beverages "on the run" as while walking, riding in public transportation, private automobiles or the like. Open top disposable containers or cups have to a great extent become common place and to a great extent standardized as to the inverted frusto conical form for hot and cold beverages. However, the cup lids for use with such containers vary greatly as to design and a completely suitable cup lid has yet to be developed.

Problems associated with cup lids for hot beverages are often distinct from those associated with cold beverages. For example, cup lids which have a centrally located straw opening have been found to be useful with cold beverage containers but are not suitable for hot beverages which are not easily consumed through a straw.

Most of the prior cup lid designs are complicated and expensive to manufacture. Many designs can only be used in conjunction with specially manufactured cups such that the cup and lid together form a reuseable assembly which must be cleaned between uses and is thus not easily adapted for fast food type beverage dispensing. Alternatively a cup lid which may be reuseable on standard size hot beverage containers might be partially suitable for fast food dispensing, but still is too expensive to be disposable and therefore must be cleaned after each use. Other designs, while potentially disposable, are difficult to make in a configuration suitable for nesting which, of course, permits economical shipment. Others simply do not act to sufficiently retard splashing or sufficiently reduce the spill rate while simultaneously permitting consumption through the lid.

The instant invention overcomes many of these drawbacks and provides an easily manufacturable, disposable, spill resistant, nestable, easily attachable cup lid through which a beverage, hot or cold, can be consumed.

Moreover, the instant inventive cup lid can be manufactured according to the invention with a method suitable for mass production of nestable cup lids composed of coated paper, injection molded plastic, styrofoam, or vacuum formed plastic. In particular, preferred embodiments of the lid and the method of forming them relate to vacuum formed plastic cup lids.

SUMMARY OF THE INVENTION

Thus, the present invention is for a splash resistant lid for use on a beverage cup of the type having a mouth circumscribed by an upper lip from which the beverage can be consumed. The lid comprises a rim means for sealing engagement with the upper lip and extending downward into the mouth of the cup. A central cover means extends substantially horizontally from the downward extension of the rim means substantially closing the cup mouth such that an upper reservoir is formed in the cup a short distance below the lip. A depression means for defining a vertical opening in the cover such that liquid sloshed inside the cup and thus having a vertical motion toward the mouth of the cup will be deflected thereby resisting spillage. Imparting horizontal motion to the contained beverage as by tipping the cup to the users lips will cause the liquid to pass through the vertical opening in sufficient quantity for convenient consumption.

BRIEF DESCRIPTION OF THE DRAWINGS

The invention will be more fully understood from the Detailed Description which follows and with reference to the drawings of preferred embodiments in which.

DETAILED DESCRIPTION OF THE DRAWINGS

Figure 1:
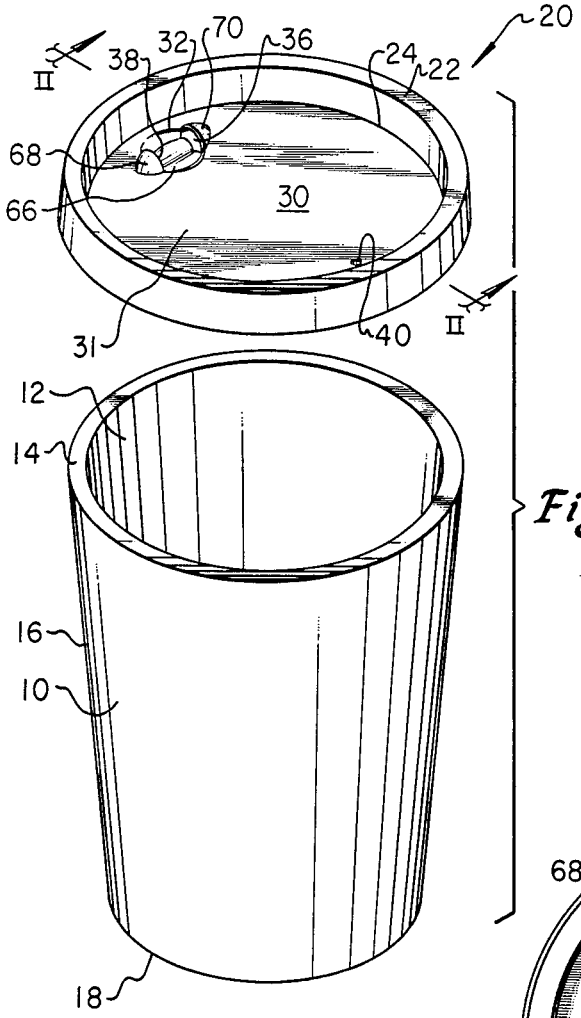
FIG. 1 is a perspective view of a cup or beverage container with one embodiment of the inventive cup lid shown in position for attachment thereto.

FIG. 1 is a perspective view of a cup 10 showing one preferred embodiment of the cup lid generally designated 20 placed thereon. The cup is of the type having a mouth 12 circumscribed by an upper lip 14 from which a beverage contained within the walls 16 and bottom 18 of the cup can be consumed. A rim means 22 is provided for sealing engagement with said upper lip 14 and extends downward into said mouth 12 to a point 24 below said upper lip 14. The rim means also extends downward on the outside of the mouth to form an inverted U-shape for engaging the lip 14 in a liquid tight manner. A central cover means 30 extends substantially horizontally from said rim means 22 at said point 24 inside the cup below said upper lip 14 substantially closing said cup mouth 12 such that an upper reservoir 31 is formed in said cup mouth 12 below said lip 14 thereof. A depression means 32 is provided for defining at least one vertical opening 36 in said central cover means 30 adjacent to said rim means 22. In the embodiment shown two vertical openings 36 and 38 are formed by depression means 32.

Figure 2:
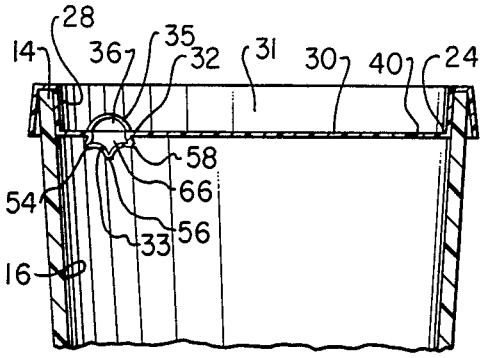
FIG. 2 is a partial cross-sectional view of the inventive cup lid in place on container taken along section line 2–2 of FIG. 1.

With reference to both FIG. 1 and FIG. 2, the details of construction of the inventive cup lid can be more fully understood. FIG. 2 is taken along section line II—II. Throughout this application, a vertical opening shall be defined as one which is defined by edges of fluid impermeable material forming the perimeter of the vertical opening, all of which edges lie in a vertical plane with respect to the cup when the bottom 18 of the cup is placed horizontally. Thus, for example, the lower edge portion 33 of depression 32 lies in a vertical plane of the vertical opening 36 abutting the plane substantially perpendicular from one direction while upper edge portion 35, which is merely a raised portion of the central cover portion 30, also lies in the same vertical plane of the vertical opening. Thus, edge portion 33 and edge portion 35 approach said plane of the vertical opening 36 from the opposite perpendicular directions.

Figure 3:
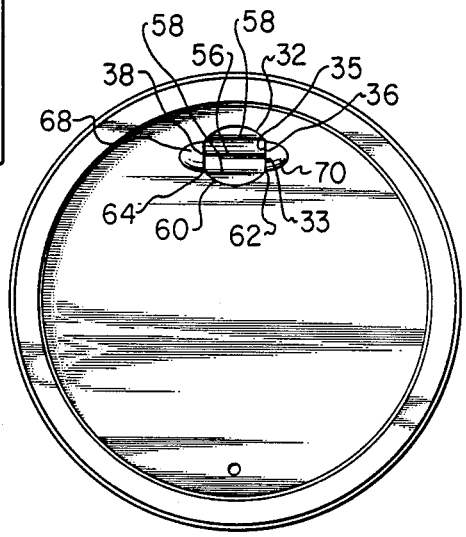
FIG. 3 is a top plan view of the inventive cup lid of FIG. 1.

From this construction, and with reference to FIG. 3, it can be understood that when viewing the cup lid from the top or the bottom, each vertical opening 36 or 38 appears as a short line without substantial width. Thus, liquid having vertical motion with respect to the cup lid will impact upon fluid impermeable material thereby deflecting its vertical motion to prevent any splashing thereof from the top of the cup.

It will further be understood, however, that with respect to liquid having horizontal motion with respect to the cup lid as may be created by tilting the cup and lid assembly, liquid will pass through the openings.

The total area of the vertical opening is uniquely limited to meter the volume of liquid flow therethrough. Thus, the total vertical opening area will preferably be sized to permit the passage of a sufficient amount of liquid upon tipping the cup for convenient consumption. It has been found that a total vertical opening area of approximately 0.1 $cm^2$ (0.015 $in^2$) will provide sufficient volume flow for convenient consumption depending upon the consistency of the liquid involved. Thus, where there are two vertical openings each will have an area of approximately 0.05 $cm^2$ (about 0.007 $in^2$). Thicker liquids such as milkshakes, expresso, or creamy hot chocolate may require a larger total vertical opening area while soft drinks, coffee, or the like work well with the indicated size. It is particularly beneficial to meter the flow of hot drinks which are not only normally sipped but which can cause discomfort if they are inadvertently sloshed while sipping.

While it will be understood that a single depression means defining a single vertical opening could be used (not shown), it has been found to be advantageous to have two vertical openings 36 and 38 formed as shown in FIGS. 1, 2 and 3. Alternatively, multiple vertical openings defined by multiple depression means could be used.

Referring again to FIG. 2, it is important that a leak proof seal be achieved between rim 28 and cup lip 14. This can be accomplished in the conventional manner, as shown, in which a rim with an inverted, U-shaped cross-section clamps over both sides of the cup lip 14. It should be noted that both the inside and the outside ends of the U-shaped cross-section angle away from each other so that nesting or stacking is permitted. Alternatively, other leak proof rim engagement means may be used consistent with the present invention. For example, where rim portion 28 is manufactured at a slight angle for press fit engagement with interior wall 16 of cup 10, a sufficient seal may be created without a U-shaped engagement. Preferably, the cup lids can be formed with rim 28 having a frusto-conical shape corresponding to standard frusto-conical shaped cups. In the case of a styrofoam cup 10 and a thermal setting plastic cup lid 20, the styrofoam and/or plastic lid will easily accommodate and deform slightly, if necessary, to conforming shapes for a liquid tight sealing engagement.

It has been found that the depth of the reservoir formed by rim portion 28 and central closure portion 30 should be sufficient to permit convenient drinking. A depth of approximately 1 cm can be advantageously used. The range, of course, may vary; however, it has been found that by providing a reservoir which is too deep, the capacity of the cup is reduced and cup lid material is wasted and by providing a reservoir which is too shallow convenient, comfortable consumption may be impeded.

Figure 4:
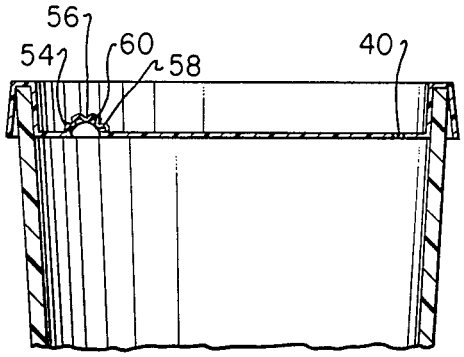
FIG. 4 is a partial cross-sectional view of the inventive cup lid shown substantially sealed.

In the embodiment of a cup lid, according to the present invention in FIG. 4, a raised oval 60 is formed upwardly from the central cover of portion 30 again adjacent one portion of rim wall 28. The raised oval 60, when made in a thermal setting plastic, becomes slightly thinner than the rest of the central cover means 30 and therefore slightly more flexible. Separation means 62 and 64 are formed as by a sharp blade used to make cuts 62 and 64 at both ends of oval 60. The cuts 62 and 64 extend down to the central cover portion 30. The cup lid is then in a condition for nesting or stacking of lids, one on top of another, and for easy transportation and storage. The cup lids can then be placed upon beverage containers for delivery to consumers in a completely sealed non-spill condition. When the beverage is to be consumed, the central portion of oval 60 is pushed downward to form depression 66, which together with raised end portions 68 and 70 comprise depression means 32 which defines vertical openings 36 and 38. As the raised oval 60 is more flexible than the surrounding central closure material 30 and as the cuts 62 and 64 are easily separable from raised end portions 68 and 70, the material forming depression 66 merely pops over center and remains in the downwardly depressed condition thereby maintaining vertical openings 36 and 38 for easy consumption. It is advantageous to provide additional flexibility through ridges 54, 56 and 58. These ridges act much like an accordian to allow the raised oval 60 to "pop" over center to become depression 66 and vice versa. The depressed middle portion 66 could also be manually pushed back into a substantially closed upward position.

Figure 5:
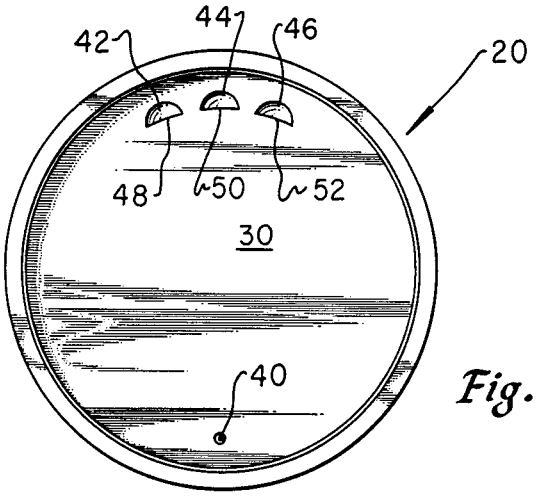
FIG. 5 is a top plan view of an alternative embodiment of the inventive cup lid.
Figure 6:
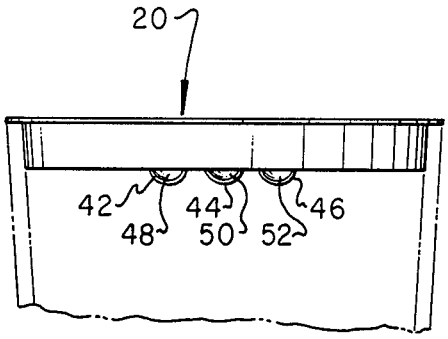
FIG. 6 is an end view of the alternative embodiment shown in FIG. 5.

With reference to FIG. 5, which is a top plan view of an alternative embodiment of the invention, and also with reference to FIG. 6, which is an end view of the alternative embodiment of FIG. 3, it can be seen that multiple depressions 42, 44 and 46 are provided defining vertical openings 48, 50 and 52. In contrast to the vertical openings in FIGS. 1, 2 and 3, which were in a vertical plane extending substantially radially from the center of the cup, the planes of the vertical openings 48, 50 and 52 are substantially perpendicular to radial lines from the center of the cup.

Again, with reference to FIGS. 5 and 6, vertical openings 48, 50 and 52 appear from the top as short lines and the combined or total opening area will be sufficient for convenient consumption. Also the separation between the openings can be varied to provide a greater or lesser range of positioning of the cup for convenient consumption. It has been found that vertical openings which are approximately 1.5 cm (0.7 in) apart work well.

Heretofore, a method of conveniently forming vertical openings in vacuum formed plastic cup lids has been unknown. The present invention provides such a procedure adaptable for presently known vacuum forming technology as described above. It will also be recognized that the previously defined embodiments of the cup lid can be accomplished using materials and methods other than vacuum forming of plastics, for example, coated paper cup lids can be easily manufactured according to applicant's invention by slicing the paper at the precise location of the intended vertical opening and then forming depressions downwardly therefrom using steam heat and pressing forms with precise alignment as is known in the coated paper forming art.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. A spill resistant lid having a rim structure adapted to engage a lip around the mouth of a drinking container in a substantially leakproof manner comprising:

a. a canopy suspended from said rim structure for forming a shallow reservoir sized to fit into said mouth of said container; and b. means for defining a vertical opening in said canopy.

2. A cup lid as in claim 1 wherein said means for defining a vertical opening comprises:

a. a short horizontal cut through said canopy having first and second ends; and b. a portion of said canopy defining a depression immediately adjacent said short horizontal cut extending from one end of said cut portion to another such that said depression is vertically separated from said cut to define said vertical opening through said canopy.

3. A cup lid as in claim 1 further comprising a plurality of spaced apart depression means adjacent said rim structure at the periphery of said canopy defining a plurality vertical openings in said canopy to increase the range of rotational drinking positions for convenient consumption from a container having said cup lid in place thereon.

4. A splash resistant lid for use on a beverage cup of the type having a mouth circumscribed by an upper lip from which said beverage can be consumed, said lid comprising:

a. a rim means for sealing engagement with said upper lip and extending downward into said mouth to a point below said upper lip;

b. a central cover means extending substantially horizontally from said rim means at said point below said upper lip substantially closing said cup mouth such that an upper reservoir is formed in said cup below the lip thereof; and c. a depression means for defining a vertical opening in said central cover means adjacent to said rim means.

5. A splash resistant lid for use with a beverage cup of the type having a lip circumscribing a single opening to a cavity in said cup, said lid comprising:

a. a central cover portion sized for insertion into said cup a predetermined distance below the lip of said cup;

b. a rim means peripherally formed about said central cover portion extending upward therefrom and sized for hand press fit sealing engagement with said cup lip such that said rim and cover form an upper reservoir partitioned by said cover from said cup cavity; and c. a depression means defining a vertical opening in said cover such that liquid held in said cup cavity having vertical motion will be deflected and only liquid having horizontal motion will pass through said vertical opening.

6. A spill resistant cup lid as in claim 1 wherein said means for defining a vertical opening comprises:

a. a raised portion in said canopy formed adjacent said rim structure having at least two end portions;

b. parallel separation means formed across said raised portion at two places adjacent said two end portions forming a depressible middle section of said raised portion which defines two vertical openings when it is depressed.

7. A spill resistant cup lid as in claim 6 wherein said parallel separation means comprise two cuts made in parallel planes through said raised portion of said canopy.

8. A spill resistant cup lid as in claim 7 further comprising ridge means extending along said depressible middle portion for increasing the flexibility of said middle portion allowing it to be depressed over center thereby forming said vertical openings.

9. A method of vacuum forming a splash resistant cup lid for use on a beverage cup of the type having a lip around a mouth thereof, said method of forming said lid comprising the steps of:

a. vacuum forming a rim structure adapted to engage said lip of said beverage cup in a substantially leak proof manner;

b. vacuum forming a canopy suspended from said rim structure for forming a shallow reservoir sized to fit into said mouth of said beverage cup;

c. vacuum forming a raised portion in said canopy adjacent said rim structure; and d. forming parallel separation means across said raised portion at two places such that a depressible middle section of said raised portion is formed which defines vertical openings at each end of said middle section when said middle section is depressed.

10. A method of forming a splash resistant cup lid as in claim 9 wherein said step of forming parallel separation means comprises shearing said raised portion in two parallel planes as said middle portion is depressed.

11. A method of forming a splash resistant cup lid as in claim 8 wherein said step of forming a raised portion comprises forming ridge means in said raised portion perpendicular to said parallel separation means extending along the top of said raised portion from one separation means to the other.

* * * * *

UNITED STATES PATENT AND TRADEMARK OFFICE

CERTIFICATE OF CORRECTION

PATENT NO. : 4,767,019

DATED : August 30, 1988

INVENTOR(S) : Tommy D. Horner

It is certified that error appears in the above-identified patent and that said Letters Patent is hereby corrected as shown below:

Column 5, Claim 3. line 4, after "plurality" insert -- of --.

Signed and Sealed this

Thirty-first Day of January, 1989

*Attest:*

DONALD J. QUIGG

*Attesting Officer*

*Commissioner of Patents and Trademarks*